United States Patent [19]

Cross

[11] Patent Number: 4,781,227

[45] Date of Patent: Nov. 1, 1988

[54] BREAKOUT DOCK FOR A WIRE HARNESS ASSEMBLY SYSTEM

[75] Inventor: Dan A. Cross, Seattle, Wash.

[73] Assignee: The Boeing Company, Seattle, Wash.

[21] Appl. No.: 67,834

[22] Filed: Jun. 29, 1987

[51] Int. Cl.[4] ..... B21F 27/00

[52] U.S. Cl. ..... 140/92.1; 24/555; 29/755

[58] Field of Search ..... 140/92.1, 93 R; 29/754, 29/755, 281.1, 33 M; 24/336, 555, 563, 564

[56] References Cited

U.S. PATENT DOCUMENTS 2,366,041 12/1944 Morehouse ..... 24/564
2,902,059 9/1959 Fiore et al. ..... 140/92.1
3,258,039 6/1966 Ewalt ..... 29/755
3,930,524 1/1976 Tarbox ..... 140/93 R

*Primary Examiner*—Lowell A. Larson
*Attorney, Agent, or Firm*—John C. Hammar

[57] ABSTRACT

To support robotic assembly of wire harnesses having wires with loop or lug terminals, a breakout dock includes a support for robotic breakout of the wire from the bundle and a clamp for receiving that wire from a wire routing tool on the robot. The clamp generally includes opposed spring leaves that are wedged apart by the lowering of the wire routing tool into the mouth of the clamp. Position indicators allow the robot to determine the precise orientation and location of the dock, including the location of the supports and clamps mounted on the dock.

20 Claims, 2 Drawing Sheets

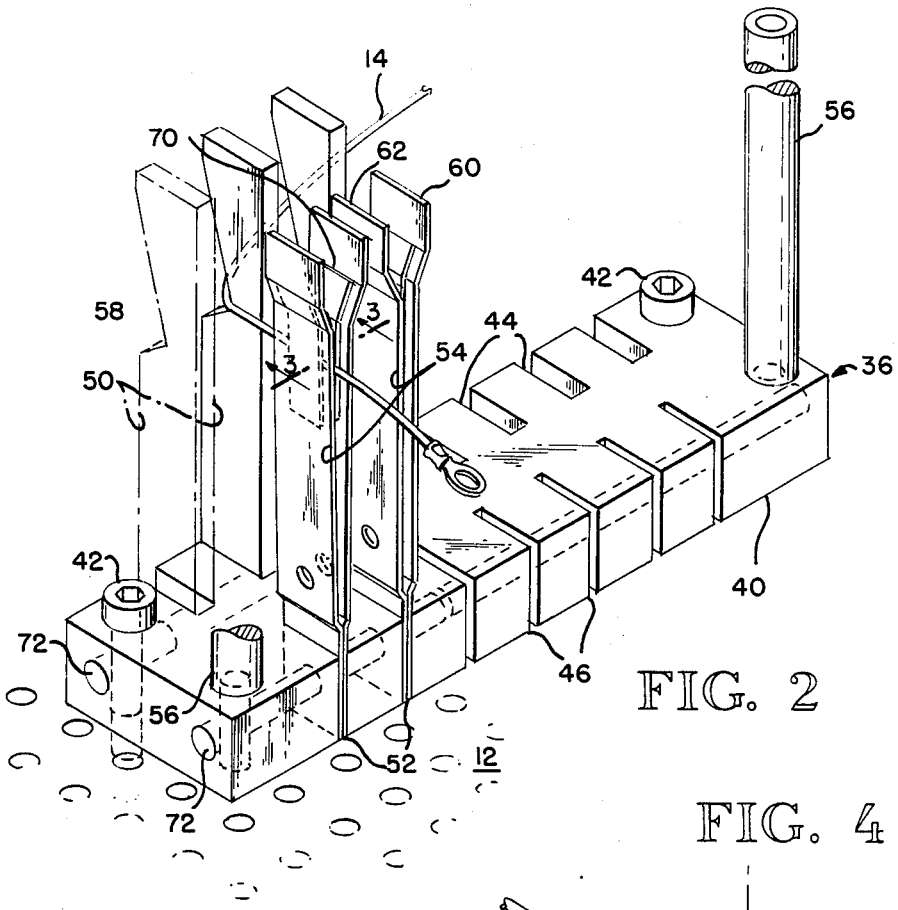
FIG. 2
FIG. 4
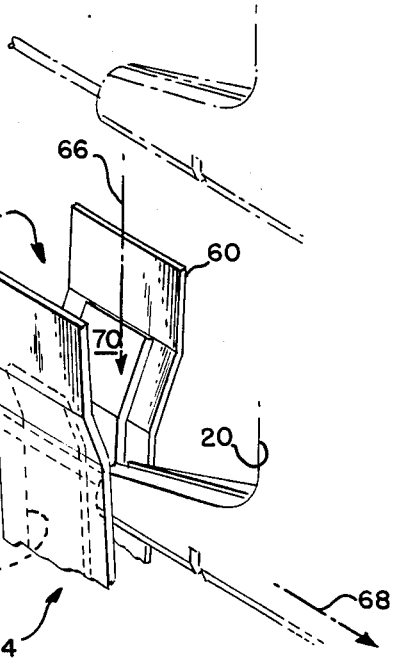
FIG. 3
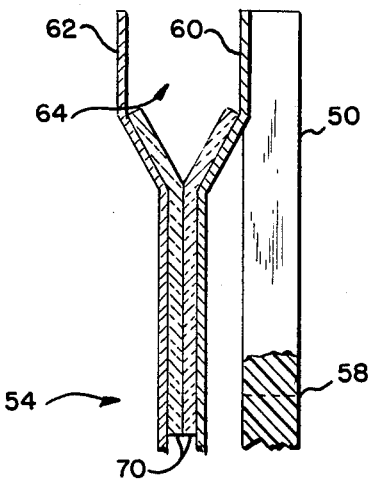

BREAKOUT DOCK FOR A WIRE HARNESS ASSEMBLY SYSTEM

GOVERNMENT RIGHTS

The U.S. Government has rights in this invention pursuant to Contract No. DAAH01-82-D-0013 awarded by the U.S. Army.

TECHNICAL FIELD

The present invention relates to an apparatus and method for securing individual ends of wire segments separated from the wire bundle of a wire harness laid up by a robot.

BACKGROUND ART

Assembly of wire harnesses is a labor-intensive task that involves selection of each wire, marking, positioning, configuring, and bundling the several wires that make up the harness. Almost all harnesses are made today by manual assembly. Such assembly is tedious and time-consuming.

While it is possible to build machines which will assemble a wire harness in a single configuration, the cost of such machinery is prohibitive for assembly of small lots of different wire harnesses. These dedicated, single task machines do not use robots, since the tasks performed are invariant. There is a need for a system with flexible automation to make wire harnesses in small lots with ease of reconfiguration allowing production of a variety of wire harnesses. Robotic assembly provides this flexible approach.

A robotic wire harness assembly system is described in copending application U.S. Ser. No. 741,318, now U.S. Pat. No. 4,677,734. In such a system, wire is dereeled, cut, and marked in the Wire Preparation subsystem using a commercial wire marker. From the wire marker, the cut/marked wire (having a length of about 8 inches to 10 feet) is loaded into a canister in a work bay of the Wire Reeling subsystem. A robot connecting the Wire Termination subsystem with the Wire Reeling subsystem picks up the loaded canister containing the wire segment (with both ends exposed) and configures each end (in a pin, lug, or other termination) as required for the particular harness under construction. The canister is, then, placed in a bay of the Queuing subsystem where it is available to a layup robot in the Wire Layup subsystem. The robot inserts one end of the wire into a connector or other tool on a layup formboard, and the wire is routed through gates to position that wire in the harness in a predetermined, reproducible shape. The second end of the wire is then inserted into another connector or tool to secure the other end. The empty canister is returned to the Queuing subsystem and, subsequently, to the work bay of the Wire Reeling subsystems, and the process for handling each wire continues until the harness is complete. The layup robot, using a variety of tools, completes all required operations including "tie wrapping."

The robot control preferably is achieved through a Data Generator control program running on a computer with down-loaded control data passing to the internal systems controller (CPU or microprocessor) of each unit in the system. The only significant manual tasks which remain are the lay-out of the proper formboard configuration (i.e., positioning the turn gates and connector blocks) and the resupply of materials to the various machines. Manual override of the system or any subsystem is possible.

In such a robotic wire harness assembly system, formboard tools are required to hold the wires that are laid out by the robot. The present invention relates to one such tool for allowing breakout of one or more wires from the harness.

SUMMARY OF THE INVENTION

A breakout dock holds the ends of individual wire segments in a wire harness. These wire segments, which are separated from the trunk or a branch of the harness, are unterminated or include loop terminals or lugs. The dock includes a spring clamp for receiving and holding each wire end. A post or support on the dock allows the robot to break the wire out from the bundle of wires in the harness and to guide it to the clamp. Position sensors or indicators on the dock allow the robot to identify the orientation and location of the dock on the formboard and the positions of each support and clamp on the dock. The dock allows robotic "tie wrapping" following completed assembly since only the ends of each wire are separated at the bend support from the harness trunk or branch.

Preferably, the breakout dock includes a base having a plurality of slots arranged in pairs. In each pair, one slot is sized to receive and position the support or post, which is preferably a rectangular plate of nylon having a concave notch on one edge. The other slot is slightly offset from the support slot transversely across the base and is sized to receive the foot of the clamp having a diverging wire-receiving mouth at its upper end formed by diverging spring leaves. A robot can bend a wire around the support and can convey it into the mouth of the clamp. The robot can be lowered to wedge the leaves apart with its wire routing tool hardware, and can capture the wire end in the clamp by moving the routing tool horizontally to allow the clamp to close on the wire end. Pads are included between the leaves to protect the insulation on the individual wires from abrasion and to hold the wire end securely. Such pads are recessed from the edges of the leaves to allow a rigid and durable point of contact between the routing tool and clamp during the wedging operation.

BRIEF DESCRIPTION OF THE DRAWINGS

FIG. 2 is a more detailed view of a preferred embodiment of the breakout dock of the present invention.

FIG. 3 is a Partial sectional view of a clamp and bend support taken generally along line 3—3 of FIG. 2.

FIG. 4 is a schematic, detailed isometric illustrating insertion of a wire into a clamp.

BEST MODE CONTEMPLATED FOR MAKING AND USING THE INVENTION

Figure 1:
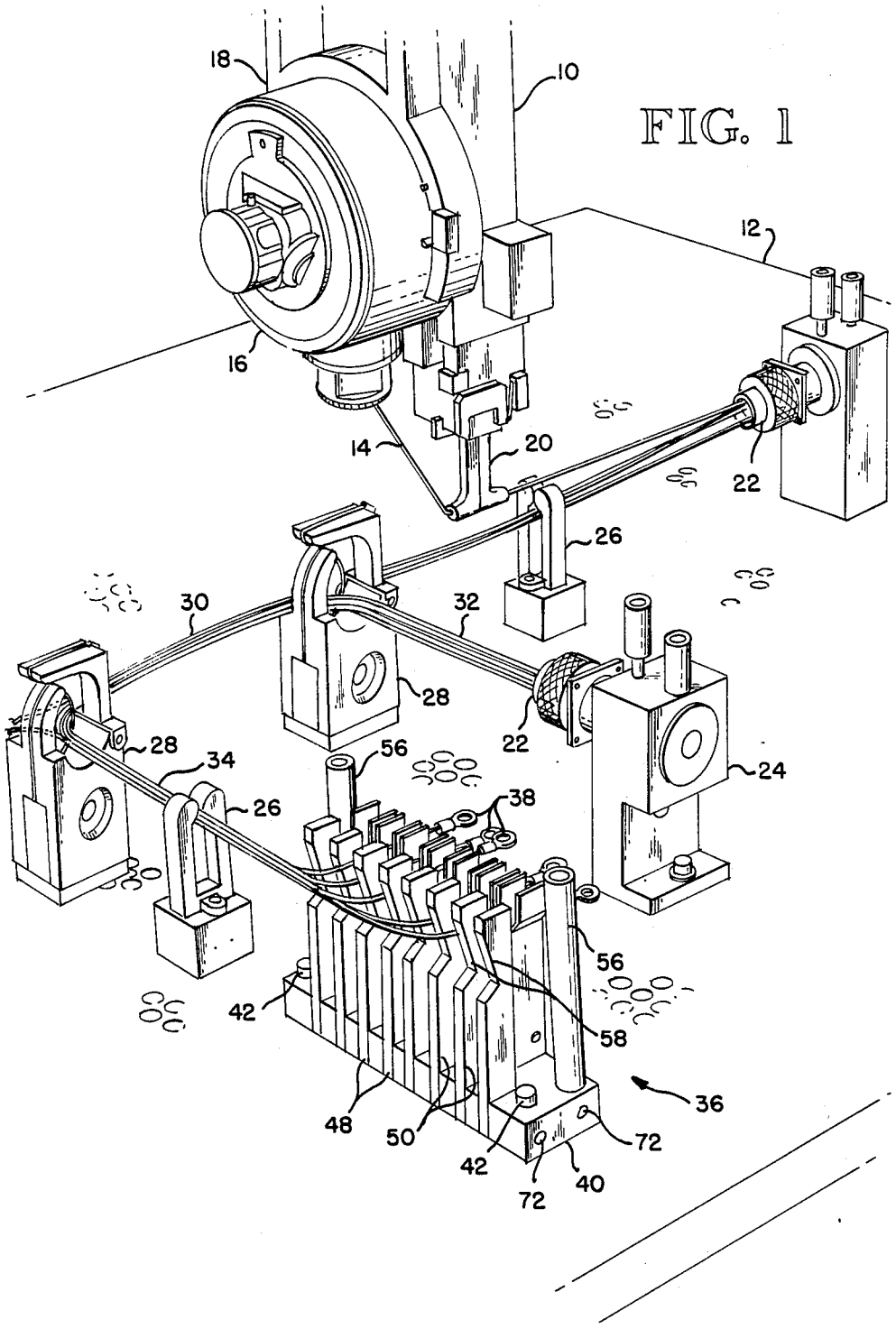
FIG. 1 is an isometric schematic of robotic lay-up of a wire harness using the breakout dock of the present invention.

Robotic assembly of a wire harness is described in U.S. Pat. No. 4,520,966 and pending U.S. patent application No. 741,318. The lay-up of each wire in the harness requires the use of specialized tools that can be mounted to the formboard, including a connector holder (described in my copending application; U.S. Ser. No. 798,828, now U.S. Pat. No. 4,692,974; which is incorporated by reference) and a turn gate (described in my copending application; U.S. Ser. No. 798,999, now U.S. Pat. No. 4,704,775; which is also incorporated by reference). The present invention describes yet another tool, a breakout dock, that can be used in the robotic assembly.

As shown in FIG. 1, a robot 10 moves over a formboard 12 to dispense each wire segment 14 of the harness from a canister 16 held in the robot 10 by a clamp 18. The robot 10 places each wire in a predetermined position in the harness. The robot 10 includes a wire routing tool 20 that guides the wire segment 14 to and through the several lay-up tools that facilitate assembly of the harness. Generally the wires ends are preconfigured and the wires are precut to length. The wire routing tool 20 inserts a pin end of a wire segment 14 into a connector 22 held in a connector holder 24. As the robot 10 moves over the formboard 12, the wire segment 14 unreels from the canister 16 and begins to shape the harness. The wire segment 14 can be passed through tie clips 26 or around turn gates 28 to define the trunk 30 and branches 32 and 34 of the harness. The wire segments 14 in branch 32 terminate in a second connector 22 mounted in a second connector holder 24. The wire segments in branch 34 are broken out from the branch with a breakout dock 36 that secures the lugs or terminals 38 of the wire ends.

The breakout dock 36 is shown in detail in FIG. 2. It includes a base 40 that can be accurately positioned and oriented to the formboard 12 with bolts 42. The base 40 includes a plurality of pairs of slots or grooves, each pair having a support slot 44 and a clamp slot 46 positioned transversely across the width of the base 40 on opposite edges of the base. The support slots 44 are sized to receive the foot 48 of a support (or post) 50 while the clamp slot 46 is sized to receive the foot 52 of a spring clamp 54. The support slot 44 and clamp slot 46 of each pair are slightly offset from one another across the base, the offset corresponding generally to the width of the wire routing tool 20 that must turn at the support 50 and guide the wire segment 14 into the clamp 54.

The base 40 also includes one or more position indicators 56 that allow the robot 10 to determine precisely the position and orientation of the breakout dock. Each indicator 56 extends above the supports 50 and clamps 54 so that the precise determination can be made without damaging the location determining tool (not shown) or the robot. The position indicators 56 may be contact points for the robot, may include reflectors for optical position sensing, or may have both.

A wire segment 14 is secured in a clamp 54 of the breakout dock 36 by bending the segment around the support 50 and clamping the end. The support 50 includes a concave notch 58 for guiding and receiving the segment 14. The facing or bearing surface of the notch 58 is made from a non-abrasive material to avoid damage to the insulation on the wire segment. Generally the entire support 50 is made from nylon.

The clamp 54 comprises two spring leaves 60 and 62 that are bent apart near their upper ends to form a mouth 64 for the clamp. The mouth 64 (FIG. 3) is sized to receive the wire routing tool 20 that passes through the clamp in securing the end of the wire segment. As shown schematically in FIG. 4, the wire routing tool 20 moves vertically downwardly generally along direction 66 through the mouth 64 along the edge of the clamp 54 to wedge the spring leaves 60 and 62 of the clamp apart and to position the wire segment between the leaves. By moving the wire routing tool horizontally generally along direction 68, the leaves 60 and 62 spring back to their rest positions, firmly securing the wire segment.

Non-abrasive, resilient, wire-protecting pads 70 are positioned on the opposing faces of the spring leaves 60 and 62 to protect the insulation on the wire segment and to retain the wire end securely. Each pad 70 is recessed inwardly from the edges of the leaf to which it is attached to allow repeated wedging apart of the leaves by the wire routing tool. The pads are also recessed from the top of each leaf to protect the pads against unnecessary wear.

As best shown in FIG. 2, the supports 50 and clamps 54 are secured in the base 40 with locking pins 72 that project through corresponding bores in the base 40 and the feet of each support or clamp. Other means, such as detents, might be used to secure or lock the supports and clamps to the base.

The slots in the base are accurately machined along the length of the base so that a robot can identify precisely through its detection system and software where to turn to breakout the wire segment and where the descend to wedge open the spring leaves.

A suitable wire routing tool 20 is described in my copending application, U.S. Ser. No. 798,827.

Although described as a tool for holding the second end of the wire segments, the breakout dock can also be used at the lead end in an analogous manner, with the routing tool wedging apart the leaves as it descends between the support and clamp.

While preferred embodiments of the invention have been shown and described, those skilled in the art will recognize variations, modifications, or alterations of the invention that might be made to the preferred embodiments without departing from the inventive concept. The description and drawings are meant to illustrate the invention and not to limit it. The claims should be construed liberally in light of the description and drawings to Protect the invention, its preferred embodiments, and its full range of equivalents. The claims should only be limited as is necessary in view of the pertinent prior art.

I claim:

1. A breakout dock for holding individual wire ends separated from a wire harness bundle, the dock being adapted for robotic assembly of the wire harness and comprising:

(a) a support allowing separation of the wire from the bundle, the support including a bearing surface having means for precisely positioning the wire at a predetermined location and predetermined height;

(b) a clamp positioned adjacent to and associated with the support for receiving and retaining the separated wire; and (c) at least one position indicator for allowing a robot to determine the location and orientation of the support and the clamp.

2. The dock of claim 1 further comprising:

(a) a base having a plurality of slots arranged in pairs, each pair including a support slot for the support and a clamp slot for the clamp; and (b) means for mounting the base to a formboard.

3. The dock of claim 2 wherein the positioning means of the support includes a V-shaped concave notch on one side, the notch defining the bearing surface and having the point of the "V" define the predetermined location and predetermined height.

4. The dock of claim 2 wherein the clamp includes opposed spring leaves.

5. The dock of claim 4 wherein each leaf of the spring includes a pad attached to the inner surface of the leaf.

6. The dock of claim 4 wherein the support includes a V-shaped concave notch on one side, the notch defining the bearing surface and the "V" defining the positioning means.

7. The dock of claim 6 wherein the notch is faced with a non-abrasive material.

8. The dock of claim 6 wherein the support slot and the clamp slot of each pair are offset transversely across the base.

9. The dock of claim 8 further comprising means for securing the support and the clamp in their respective slots.

10. The dock of claim 8 wherein the clamp includes a mouth formed by diverging, bent upper ends of the spring leaves.

11. The dock of claim 10 wherein the "V" of the notch is below the bottom of the mouth of the clamp.

12. A breakout dock for holding individual wire ends separated from a wire harness bundle, the dock being adapted for robotic assembly of the wire harness and comprising:

(a) a base having a plurality of slots arranged in pairs, each pair including a support slot for receiving a support and a clamp slot for receiving a clamp, the support slot being offset transversely across the base from the clamp slot of each pair;

(b) means for mounting the base to a formboard;

(c) means for robotic determination of the precise location and orientation of the base on the formboard and, thereby, the precise location and orientation of the slots in the base;

(d) at least one support having a foot sized for being received in the support slot of the base, a concave notch along one edge, and means associated with the notch, for precisely positioning the wire at a predetermined height; and (e) a clamp having a foot sized for being received in the clamp slot of the base in the pair, having opposed spring leaves attached to the foot, and having a mouth formed by diverging, bent, upper ends of each leaf.

13. The dock of claim 12 further comprising means for securing the slot and the clamp in their respective slots.

14. The dock of claim 12 further comprising pads attached to the opposing surfaces of the leaves.

15. The dock of claim 14 wherein the robotic determination means includes a plurality of position indicators attached at predetermined locations on the base.

16. The dock of claim 14 wherein the notch is faced with a non-abrasive material.

17. The docks of claim 16 wherein the pads are recessed from the edges of the leaves.

18. A method for holding individual wires separated from a bundle of wires in a wire harness comprising the steps of:

(a) securing the first end of a precut, preconfigured wire in a tool on a layout formboard;

(b) robotically laying out the wire into its position in the bundle of the harness;

(c) robotically separating the wire from the bundle by bending the wire with a wire routing tool around a post;

(d) clamping the separated wire; and (e) releasing the wire.

19. The method of claim 18 wherein the step of clamping comprises the substeps of:

(a) wedging opposed leaves of a spring-leaf clamp apart with the substantially vertical downward movement of the wire routing tool; and (b) moving the wire routing tool horizontally out from between the leaves to clamp the leaves onto the wire.

20. The method of claim 19 wherein the step of wedging includes moving the wire routing tool vertically downward along one edge of the clamp to spread the leaves of the spring-leaf clamp.

* * * * *